US005243312A

United States Patent [19]

Schedele

[11] Patent Number: 5,243,312

[45] Date of Patent: Sep. 7, 1993

[54] ELECTROMAGNETIC RELAY

[75] Inventor: Helmut Schedele, Diessen, Fed. Rep. of Germany

[73] Assignee: Siemens Aktiengesellschaft, Munich, Fed. Rep. of Germany

[21] Appl. No.: 809,542

[22] PCT Filed: Nov. 16, 1989

[86] PCT No.: PCT/DE89/00720

§ 371 Date: Jan. 27, 1992

§ 102(e) Date: Jan. 27, 1992

[51] Int. Cl.[5] ..... H01H 51/22

[52] U.S. Cl. ..... 335/78; 335/128

[58] Field of Search ..... 335/78-86, 335/124, 128, 133

[56] References Cited

U.S. PATENT DOCUMENTS 3,626,339 12/1971 Lisnay .
4,688,010 8/1987 Nobutoki et al. .
4,831,348 5/1989 Agatahama et al. ..... 335/80
5,084,688 1/1992 Martino ..... 335/78

FOREIGN PATENT DOCUMENTS 0186160 7/1986 European Pat. Off. .
2733800 2/1979 Fed. Rep. of Germany .
2830390 1/1980 Fed. Rep. of Germany .
2335030 7/1977 France .
2347769 11/1977 France .

*Primary Examiner*—Lincoln Donovan
*Attorney, Agent, or Firm*—Hill, Steadman & Simpson

[57] ABSTRACT

The relay has an actuation member (7) which is connected to the armature (6) and which covers by means of a partition (76) the entire surface between the magnet system (2, 4, 5) and the contact system (8) and also surrounds the contact system (8) and/or the magnet system (2, 3, 4, 5) with integral side walls (71, 72, 74) in the form of a tub. As a result, very long creepage distances and clearances between the coil and the contact system are ensured in a relay of small dimensions.

9 Claims, 3 Drawing Sheets

ELECTROMAGNETIC RELAY

BACKGROUND OF THE INVENTION

The invention relates to an electromagnetic relay having a magnet system with coil, core and armature, a contact system arranged adjacent to the coil with at least one movable contact element and having an actuation element made of insulating material which is arranged in the region between the magnet system and the contact system, can be moved by the armature and extends as a movable partition essentially over the entire surface between the metal parts of the magnet system on the one hand and the contact system on the other hand.

A relay of this type is already known from DE-27 33 800-A1, in which the magnet system is arranged next to the contact system on a common bottom. The contact elements are actuated by means of an angled armature, the actuation leg of which lies approximately parallel to the coil axis between the coil and the contact system and moves a cuboid actuation part arranged essentially parallel thereto. This actuation part is at the same time the support there for the movable elements of bridge contact units. Since in the known relay the aforesaid actuation part is to extend essentially over the entire length of the interior of the relay, it acts as an insulating partition between the magnet system and the contact system. However, the insulating distances (creepage distances and clearances), which are to be measured laterally at the edge of the actuation element, are not sufficient for some applications if the overall dimensions of the relay are to be reduced to a specified dimension. Moreover, the fact that an armature arm that takes up a comparatively large amount of space lies between the magnet system and the actuation element is an obstacle to the miniaturization of the relay.

An electromagnetic relay of the type mentioned at the beginning is also known from DE-28 30 390-A1, in which a polarized magnet system lies with a so-called H-armature above the contact system and a plastic part connected to the armature has an essentially plate-shaped section for the transmission of the armature movement to the contact system. The same applies also here, namely that the creepage distances and clearances between the contact system and the metal parts of the magnet system in the edge region of the actuation part do not meet the very high insulation requirements and that on the other hand the armature with the aforesaid plate-shaped actuation part as well as with additional further actuation parts connected between requires a comparatively large volume, which conflicts with an extreme miniaturization of such a relay while maintaining a high electric strength.

SUMMARY OF THE INVENTION

The object of the invention is to design a relay of the type mentioned at the beginning in such a way that very large insulating distances are obtained between the magnet system and the contact system with as few easily assembled component parts as possible and with extremely small overall dimensions.

This object is achieved according to the invention in that, with integral side walls on the partition directed toward the magnet system and/or toward the contact system, the actuation element at least partially surrounds the magnet system and/or the contact system in the form of a tub.

In the relay according to the invention, therefore, very large insulating distances between the contact elements and the magnet system are produced in relation to the overall dimensions of the relay as a result of the actuation member with a trough- or tub-shaped design surrounding either the contact system or the magnet system, or also both. The actuation member or the respective part thus has in the former case a U-shaped cross-section. In the latter case, which is particularly advantageous and ensures particularly long insulating distances, the actuation member has an H-shaped cross-section. As a result of this tub or double-tub form, the actuation member is also very stable with respect to deformations, so that it can transmit the armature movement to the contact system exactly even without additional reinforcing ribs.

The invention can thus be applied particularly advantageously to a relay whose magnet system has the structure of a conventional angled armature system, but in which the angled armature unit is no longer made entirely of metal. Rather, the ferromagnetic, essentially plate-shaped armature is connected here to actuation member in such a way that the actuation member forms the second leg of the angled armature unit. The plate-shaped armature itself can be more or less surrounded by the insulating actuation member, it then being only necessary to ensure that the ferromagnetic armature has a free pole surface opposite the core pole surface. The connection between the ferromagnetic armature part and the actuation member can be realized as a plug connection, but preferably however as a bonded connection or especially as an embedding. In one particular embodiment, the actuation element, or the armature unit formed as actuation element and armature, may be mounted on the yoke by means of the armature.

Further embodiments of the relay according to the invention are as follows. The actuation member can be connected to the armature. The armature can be partially surrounded by a wall section of the actuation member and can have a free pole surface directed toward the core. The actuation member can be mounted pivotably on the yoke by means of the armature. The armature can form an angled armature unit together with the actuation member, the plate-shaped armature lying approximately perpendicular to the coil axis, and the partition formed by the actuation member extending approximately perpendicular to the armature next to a yoke leg. An actuation stud that projects toward the contact system can be formed on the partition. The partition can extend approximately parallel to the coil axis, and the contact system can have at least one contact spring likewise extending approximately parallel to the coil axis. The magnet system and the contact system can be inserted into a cap-shaped housing, which is open toward the connection side of the relay, in such a way that the magnet system lies above the contact system in relation to the connection side of the relay and the actuation element with its side walls can extend essentially parallel to the side walls of the housing in each case, almost up to the connection side. The contact system can have a support which has at least one additional insulating wall directed toward the partition.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 2:
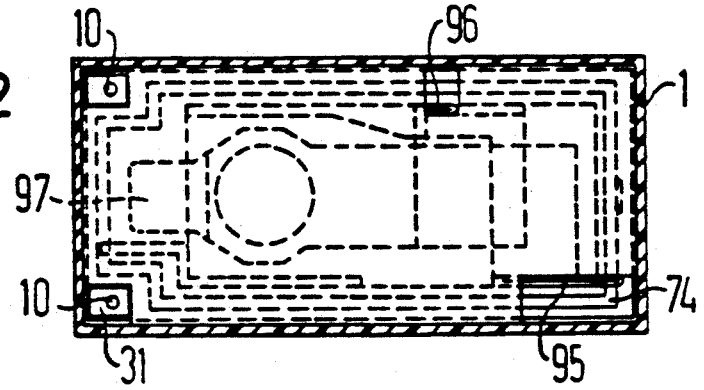
FIGS. 2 to 5 show further sectional views of the relay illustrated in FIG. 1.
Figure 1:
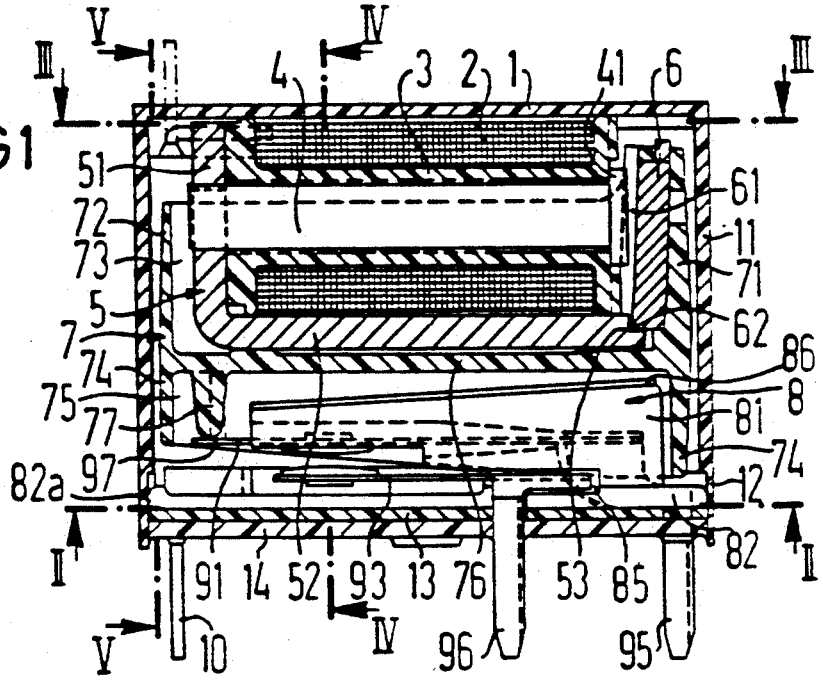
FIG. 1 shows a relay designed according to the invention in longitudinal section.
Figure 3:
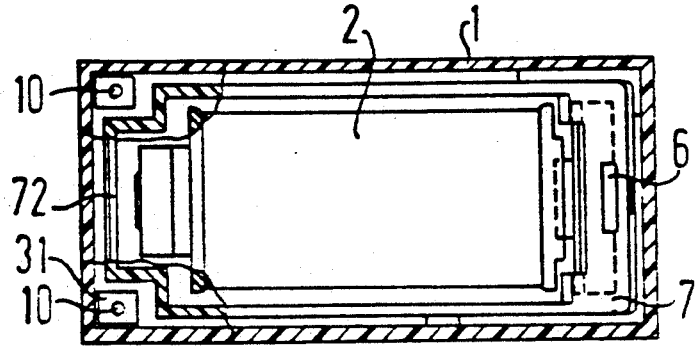
Figure 4:
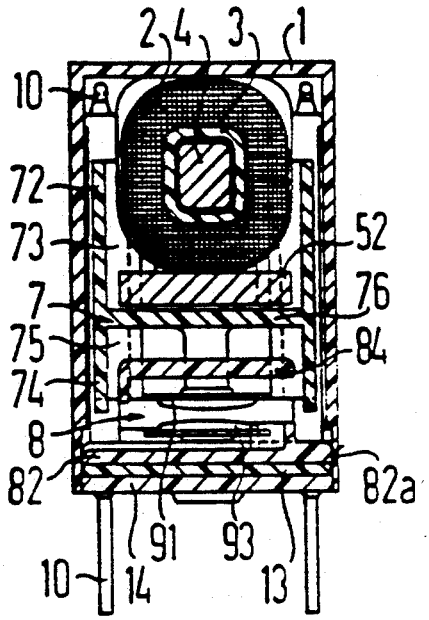
Figure 5:
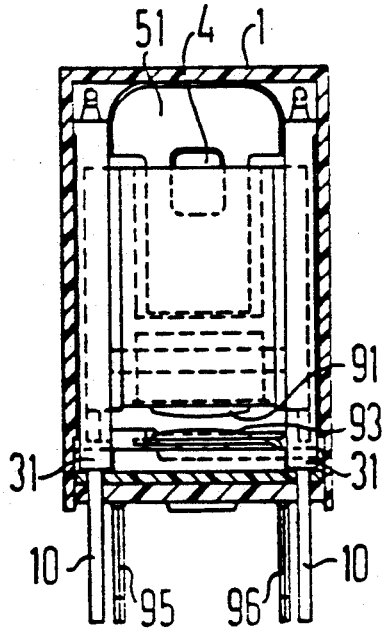

The relay illustrated in FIGS. 1 to 5 has a housing 1 in the form of a protective cap, the open side of which points downwards, that is to say toward the intallation plane of the relay. Arranged in the upper region, that is to say in the closed part of the housing 1, is a magnet system which consists of a coil winding 2 on a coil former 3, a core 4 extending axially through the coil and an angled yoke 5 which is connected to the core 4 with a perpendicularly extending leg 51 and which extends parallel to the coil axis and to the axis of the core with a leg 52 that extends horizontally below the coil. The free end of the core 4 forms a pole plate 41, which lies opposite an armature 6 in the form of a ferromagnetic plate.

The armature 6 is connected with an actuation member 7 to a fixed armature unit. In this arrangement the armature 6 is embedded or bonded in a side wall 71 of the actuation member in such a way that essentially only the pole surface 61, which lies opposite the core pole plate 41, is exposed. Other fastening methods, such as ultrasonic welding and the like, can of course also be used for the connection between the armature and the actuation member. The side wall 71 of the actuation member 7 continues in a surrounding wall 72 and thus forms a tub 73 which partially surrounds the magnet system and is open to the top. In addition, the actuation member also forms a surrounding wall 74 toward the underside, which thus forms a tub 75 which is open to the bottom and partially surrounds a contact system 8. Both tubs 75 and 73 are delimited from one another by a common bottom or a partition 76, as a result of which the contact system 8 is insulated from the coil and from the yoke. The partition 76 extends essentially parallel to the coil axis and perpendicular to the armature 6. It thus forms the second leg of an angled armature unit formed by the armature 6 and the actuation member 7. Owing to the surrounding side walls 72 and 74, the actuation member is also sufficiently stiffened so that is does not bend upon actuation. In. relation to the overall dimensions of the relay, the side walls 72 and 74 also produce very long creepage distances and clearances between the contact system 8 and the coil 2 or also the metallic parts of the magnetic circuit respectively.

Figure 6:
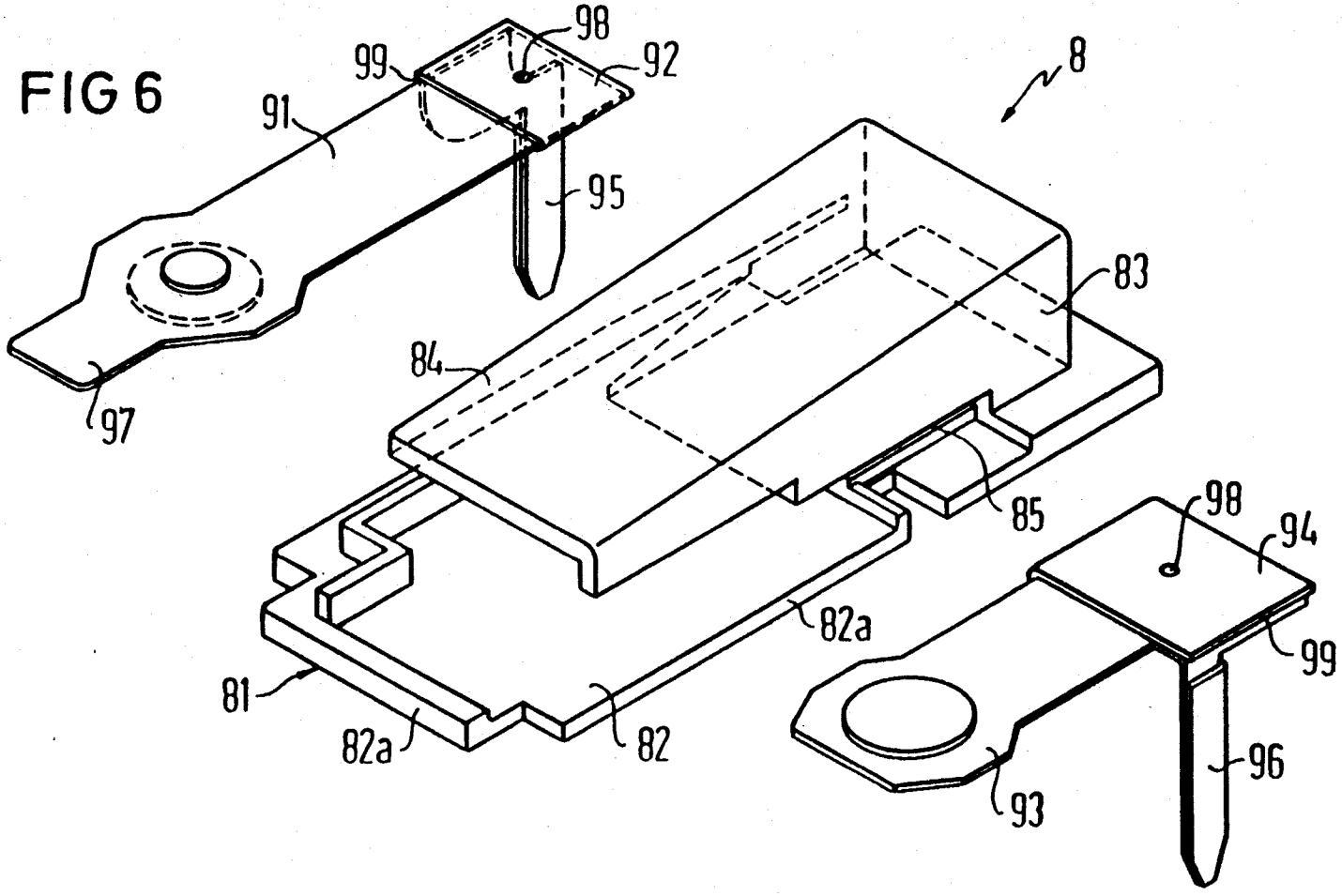
FIG. 6 shows the contact system from FIG. 1 in an exploded representation.

In the present case the contact system is mounted on an insulating support 81, which consists integrally of a plate-shaped base part 82, a fastening block 83 and a cover part 84. Formed in the fastening block 83 from both sides in each case are receiving slits 85 (only visible on one side in FIG. 6), in which a contact spring 91 with a folded fastening part 92 and also a counter contact spring 93 with a folded fastening part 94 are inserted. Each of the contact elements 91 and 93 has a connection prong 95 and 96, respectively, formed by the folding of the spring plate. As a result of the folding, the fastening parts 92 and 94 respectively attain in each case the thickness and stability required for the plug-in fastening, it also being possible to join the superjacent sections by means of a weld 98 if required. The section bent over additionally forms a protruding edge 99 in each case, against which an assembly tool for pressing the respective contact element 91 or 93 into the support 81 can be placed.

The contact spring 91 is freely movable outside its clamping point. At its free end 97 it is actuated in accordance with the switching movement of the armature by means of an actuation stud 77 of the actuation member 7. The cover part 84 of the support 81 forms an additional insulating wall between the contact system and the magnet system, only the free end 97 of the contact spring 91 protruding for the purpose of actuation. Insofar as a third insulating layer is required in addition to the partition 76 and the cover part 84, it is possible to place on or bond onto the latter an additional film 86, as is indicated in Figure but not illustrated in FIG. 6.

If for functional reasons it is necessary to design the cover part 84 to be smaller, it is expedient to apply one or more films to the partition 76. It is also possible to design the partition 76 by means of interspaces in such a way that at least three insulating walls are produced.

Instead of the one make contact shown in the example, it is of course also possible to employ any other spring assembly in the relay, for example a break contact, changeover switch or also a spring assembly with a plurality of units.

During the assembly of the relay, first of all the complete armature unit, consisting of the armature 6 and the actuation member 7, is placed on the magnet system, an integral bearing edge 62 on the armature being inserted into a bearing notch 53 of the yoke. This now complete magnet system is then pushed into the housing 1, the coil, consisting of winding 2 and coil former 3, preferably being clamped fast or bonded fast in the closed end part of the housing 1. The armature unit is thus protected against falling out by the side wall 11 of the housing 1.

The contact system 8 is then inserted into the open side of the housing 1, the recessed edge region 12 of the housing forming a straight guide for the base 82 of the contact system. The outer edge **82*a* of this base 82 is largely matched to the contour of the housing edge 12; it has however some cutouts for the passage of the contact connection prongs 95 and 96 as well as the insulating jacket 31 of the coil connection pins 10. During insertion, the base 82 is not moved against a stop of the housing, but rather is pushed in with an excited magnet system until the contact spring 91 is actuated by the stud 77 and the contact is made with the counter contact element 93. The excitation of the relay is then switched off so that the contact opens. The contact system 8 is now additionally pushed in by a given amount which ensures a specific contact erosion safety margin of the contacts. The contact system, that is to say the base 82**, is then fixed with respect to the housing, which can be accomplished by means of a fast-acting adhesive for example.

To seal the remaining openings in the bottom, a covering plate 13 is pushed over the connection pins 95, 96 and 10. Encapsulation compound 14 is then introduced from the outside into the space formed by the covering plate 13 and the housing edge 12, which completes the sealing of the housing. It is of course also possible to provide a ventilation hole in the housing in the conventional manner, which can be opened during or also after the sealing and closed later.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. An electromagnetic relay having a magnet system with a coil, a core, a yoke and an armature, a contact system arranged adjacent to the coil with at least one movable contact element, and an actuation member made of insulating material which is arranged in a region between the magnet system and the contact system, the actuation member being moveable by the armature and extending as a movable partition substantially over an entire surface between the magnet system and the contact system, comprising: the actuation member having integral side walls on the partition directed toward at least one of the magnet system and the contact system, the actuation member at least partially surrounding at least one of the magnet system and the contact system in the form of a tub.

2. The relay according to claim 1, wherein the actuation member is rigidly connected to the armature.

3. The relay according to claim 1, wherein the armature is partially surrounded by a wall section of the actuation member and has a free pole surface directed toward the core.

4. The relay according to claim 1, wherein the actuation member is mounted pivotably on the yoke by means of the armature.

5. The relay according to claim 1, wherein the armature forms an angled armature unit together with the actuation member, the armature being plate-shaped and lying approximately perpendicular to an axis of the coil, and the partition formed by the actuation member extending approximately perpendicular to the armature next to a yoke leg of the yoke.

6. The relay according to claim 1, wherein an actuation stud that projects toward the contact system is formed on the partition.

7. The relay according to claim 1, wherein the partition extends approximately parallel to an axis of the coil, and wherein the contact system has at least one contact spring likewise extending approximately parallel to the axis of the coil.

8. The relay according to claim 1, wherein the magnet system and the contact system are located a cap-shaped housing, which is open toward a connection side of the relay, the magnet system lying above the contact system in relation to the connection side of the relay and the actuation element with the side walls thereof extending substantially parallel to side walls of the housing, almost up to the connection side.

9. The relay according to claim 1, wherein the contact system has a support which has at least one additional insulating wall directed toward the partition.

* * * * *